US010995975B2

(12) United States Patent
Kondou et al.

(10) Patent No.: US 10,995,975 B2
(45) Date of Patent: May 4, 2021

(54) ICE MAKING SYSTEM

(71) Applicant: DAIKIN INDUSTRIES, LTD., Osaka (JP)

(72) Inventors: Azuma Kondou, Osaka (JP); Takeo Ueno, Osaka (JP); Kouichi Kita, Osaka (JP); Ryouji Matsue, Osaka (JP); Satoru Ohkura, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/771,442

(22) PCT Filed: Dec. 14, 2018

(86) PCT No.: PCT/JP2018/046057
§ 371 (c)(1),
(2) Date: Jun. 10, 2020

(87) PCT Pub. No.: WO2019/138779
PCT Pub. Date: Jul. 18, 2019

(65) Prior Publication Data

US 2021/0071927 A1 Mar. 11, 2021

(30) Foreign Application Priority Data

Jan. 15, 2018 (JP) ..... JP2018-004025

(51) Int. Cl.
*F25C 1/08* (2006.01)

(52) U.S. Cl.
CPC ..... *F25C 1/08* (2013.01); *F25C 2301/002* (2013.01); *F25C 2400/10* (2013.01);
(Continued)

(58) Field of Classification Search
CPC .. F25C 2700/08; F25C 5/10; F25C 2301/002; F25C 2700/00
See application file for complete search history.

(56) References Cited

U.S. PATENT DOCUMENTS 6,000,228 A * 12/1999 Johnson ..... F25C 1/12 62/73
2004/0231354 A1* 11/2004 Tsuchikawa ..... F25C 1/147 62/353

FOREIGN PATENT DOCUMENTS

JP H1-210784 A 8/1989
JP H05-34043 A 2/1993
(Continued)

OTHER PUBLICATIONS

International Preliminary Report on Patentability issued in corresponding International Patent Application No. PCT/JP2018/046057, dated Jul. 21, 2020 (8 pages).
(Continued)

*Primary Examiner* — Cassey D Bauer
(74) *Attorney, Agent, or Firm* — Osha Bergman Watanabe & Burton LLP

(57) ABSTRACT

An ice making system includes: a tank that stores a medium to be cooled; an ice making machine that cools the medium and makes ice; a pump that circulates the medium between the tank and the ice making machine; a de-icing mechanism that performs a de-icing operation of heating and melting the medium in the ice making machine; and a control device that controls operations of the ice making machine, the pump, and the de-icing mechanism. The ice making machine includes: a cooling chamber in which the medium is cooled; a blade mechanism that rotates in the cooling chamber and disperses the ice; a detector that detects a locked state of the blade mechanism; and a first temperature sensor that is disposed at a discharge port of the cooling chamber and detects a temperature of the medium discharged from the cooling chamber.

12 Claims, 7 Drawing Sheets

(52) U.S. Cl.
CPC ..... *F25C 2400/14* (2013.01); *F25C 2600/04* (2013.01); *F25C 2700/00* (2013.01)

(56) References Cited

FOREIGN PATENT DOCUMENTS

| | | | |
|---|---|---|---|
| JP | 2003-185285 | A | 7/2003 |
| JP | 2006-242447 | A | 9/2006 |
| JP | 2014-070823 | A | 4/2014 |

OTHER PUBLICATIONS

International Search Report issued in International Application No. PCT/JP2018/046057, dated Feb. 12, 2019 (3 pages).
Notification of Reasons for Refusal issued in Japanese Patent Application No. 2018-232182, dated Feb. 5, 2019 (9 pages).
Notification of Reasons for Refusal issued in Japanese Patent Application No. 2018-232182, dated May 14, 2019 (4 pages).
Extended European Search Report issued in corresponding European Application No. 18899412.3, dated Feb. 8, 2021 (8 pages).

* cited by examiner

ICE MAKING SYSTEM

TECHNICAL FIELD

The present invention relates to an ice making system.

BACKGROUND

Patent Literature 1 discloses an ice making refrigeration apparatus including a double-pipe flooded evaporator having an inner pipe through which a medium to be cooled flows, and an outer pipe containing the inner pipe. This ice making refrigeration apparatus expands, with an expansion mechanism, high-pressure liquid refrigerant flowing out of a condenser to reduce the pressure of the refrigerant, and supplies the low-pressure liquid refrigerant into an outer cooling chamber provided between the inner pipe and the outer pipe of the flooded evaporator. As a result, the medium to be cooled flowing through the inner pipe is cooled, while the liquid refrigerant in the outer cooling chamber evaporates. The medium to be cooled in the inner pipe turns into slurry ice after the subcooled state of the medium is undone by a rotary blade. The low-pressure refrigerant that has evaporated in the outer cooling chamber is discharged from the flooded evaporator and returned to a suction side of a compressor.

In this type of ice making refrigeration apparatus, a phenomenon may occur in which ice gathers and adheres to a part inside an inner pipe and a rotary blade is caught by the ice, thus increasing a rotational load (this phenomenon is also referred to as "ice lock"). Such a phenomenon makes it difficult to continuously operate an ice making machine. However, no countermeasures have been taken against these phenomena in the ice making refrigeration apparatus described in Patent Literature 1.

PATENT LITERATURE

Patent Literature 1: Japanese Unexamined Patent Publication No. 2003-185285

SUMMARY

One or more embodiments of the present invention provide an ice making system that can eliminate, at an early stage, ice lock that has occurred in an ice making machine.

(1) An ice making system according to one or more embodiments of the present invention includes:

a tank that stores a medium to be cooled;

an ice making machine that cools the medium to be cooled and makes ice;

a pump that circulates the medium to be cooled between the tank and the ice making machine;

a de-icing mechanism that performs a de-icing operation of heating and melting the medium to be cooled in the ice making machine; and a control device that controls operations of the ice making machine, the pump, and the de-icing mechanism, wherein the ice making machine includes:

a cooling chamber in which to cool the medium to be cooled;

a blade mechanism that rotates in the cooling chamber to disperse the ice; and a detector that detects a locked state of the blade mechanism, and the control device stops the blade mechanism and operates the de-icing mechanism when the detector detects the locked state of the blade mechanism.

This configuration makes it possible to detect that ice lock has occurred in the ice making machine and to perform the de-icing operation.

(2) According to one or more embodiments, the control device stops the pump during the de-icing operation.

This configuration makes it possible to suppress the melting of the ice in the tank, which would be caused by a temperature rise in the tank.

(3) According to one or more embodiments, the ice making system further includes a refrigerant circuit that is formed by connecting, with a refrigerant pipe, a compressor, a heat source-side heat exchanger, an expansion mechanism, and a utilization-side heat exchanger in that order, the utilization-side heat exchanger constitutes a part of the ice making machine, and exchanges heat with the medium to be cooled in the cooling chamber to evaporate refrigerant during an ice making operation, and the de-icing mechanism includes the refrigerant circuit and a four-way switching valve connected to a discharge side of the compressor in the refrigerant circuit, the four-way switching valve being configured to switch the ice making operation to the de-icing operation by switching a flow path of the refrigerant, discharged from the compressor, from a path leading to the heat source-side heat exchanger to a path leading to the utilization-side heat exchanger.

This configuration makes it possible to perform the de-icing operation using the refrigerant circuit in which the ice making machine makes ice.

(4) According to one or more embodiments, the ice making system includes a first temperature sensor that detects a temperature of the medium to be cooled discharged from the cooling chamber, and the control device stops the de-icing operation when the temperature detected by the first temperature sensor exceeds a predetermined temperature.

This configuration makes it possible to appropriately set the timing for stopping the de-icing operation based on the temperature of the medium to be cooled discharged from the cooling chamber, and to melt the ice in the cooling chamber to such an extent that the ice lock does not occur again when the de-icing operation is switched back to the ice making operation. The predetermined temperature can be, for example, 0° C.

(5) According to one or more embodiments, the ice making system includes a second temperature sensor that detects an operating temperature of the de-icing mechanism, and the control device preferably stops the de-icing operation when the temperature detected by the second temperature sensor exceeds a predetermined temperature.

This configuration makes it possible to appropriately set the timing for stopping the de-icing operation based on the operating temperature of the de-icing mechanism.

DETAILED DESCRIPTION

Embodiments of an ice making system will be described in detail below with reference to the accompanying drawings. Note that the present invention is not limited to the following examples, but is indicated by the appended claims and is intended to include all modifications within the scope and meaning equivalent to those of the claims.

<Overall Configuration of Ice Making System>

Figure 1:
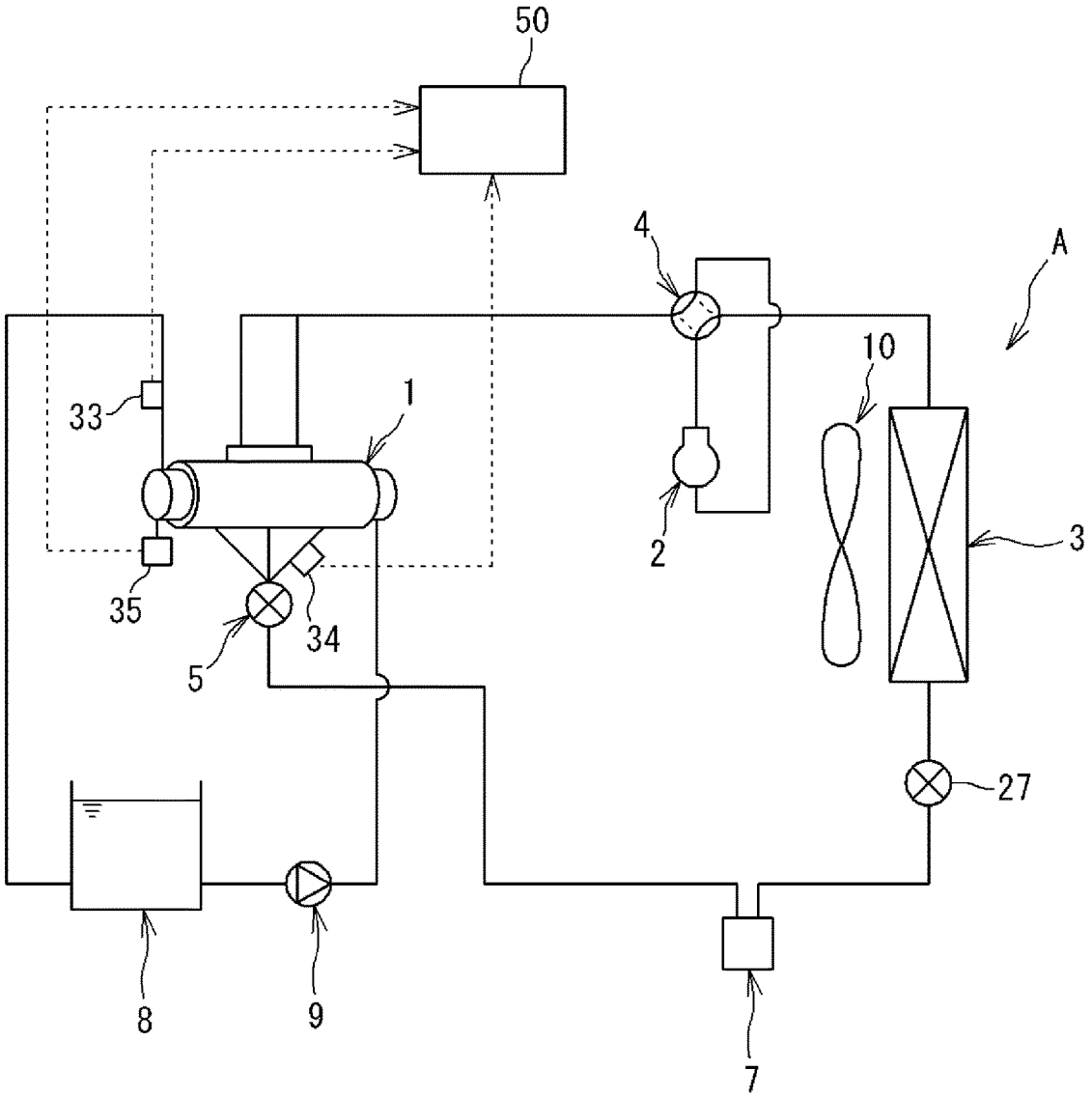
FIG. 1 is a schematic configuration diagram of an ice making system according to one or more embodiments.

FIG. 1 is a schematic configuration diagram of an ice making system A according to one or more embodiments.

In the ice making system A according to one or more embodiments, an ice making machine 1 continuously generates ice slurry using, as a raw material, seawater stored in a seawater tank 8 and stores the generated ice slurry in the seawater tank 8.

The ice slurry refers to sherbet-like ice in which fine ice is mixed with water or an aqueous solution. The ice slurry is also referred to as slurry ice, slush ice, or liquid ice.

The ice making system A according to one or more embodiments can continuously generate seawater-based ice slurry. Therefore, the ice making system A according to one or more embodiments is installed in, for example, a fishing boat or a fishing port, and the ice slurry stored in the seawater tank 8 is used for keeping fresh fish cool.

The ice making system A according to one or more embodiments switches operations between an ice making operation of making ice in the ice making machine 1 and a de-icing operation of melting the ice stored in the ice making machine 1.

The ice making system A uses seawater as a medium to be cooled (object to be cooled). The ice making system A includes the ice making machine 1, a compressor 2, a heat source-side heat exchanger 3, a four-way switching valve 4, a utilization-side expansion valve (expansion mechanism) 5, a receiver (liquid receiver) 7, a heat source-side expansion valve (expansion mechanism) 27, a fan 10, the seawater tank (ice storage tank) 8, a pump 9, and the like. The ice making system A also includes a control device 50.

The compressor 2, the heat source-side heat exchanger 3, the heat source-side expansion valve 27, the receiver 7, the utilization-side expansion valve 5, and the ice making machine 1 are connected in that order by a refrigerant pipe to constitute a refrigerant circuit.

The ice making machine 1, the seawater tank 8, and the pump 9 are connected by a seawater pipe to constitute a circulation circuit.

The four-way switching valve 4 is connected to a discharge side of the compressor 2. The four-way switching valve 4 has a function of switching the direction of flowing refrigerant discharged from the compressor 2, that is, flowing the refrigerant either toward the heat source-side heat exchanger 3 or the ice making machine 1. The four-way switching valve 4 switches operations between the ice making operation and the de-icing operation.

The compressor 2 compresses the refrigerant and circulates the refrigerant in the refrigerant circuit. The compressor 2 is of a variable displacement type (variable capacity type). Specifically, the compressor 2 can change the number of rotations of a built-in motor stepwise or continuously by controlling the motor with an inverter.

The fan 10 cools the heat source-side heat exchanger 3 with air. The fan 10 includes a motor, the number of rotations of which is changed stepwise or continuously through inverter control.

The utilization-side expansion valve 5 and the heat source-side expansion valve 27 are each configured by, for example, an electronic expansion valve that is driven by a pulse motor, and have an adjustable opening degree.

Figure 2:
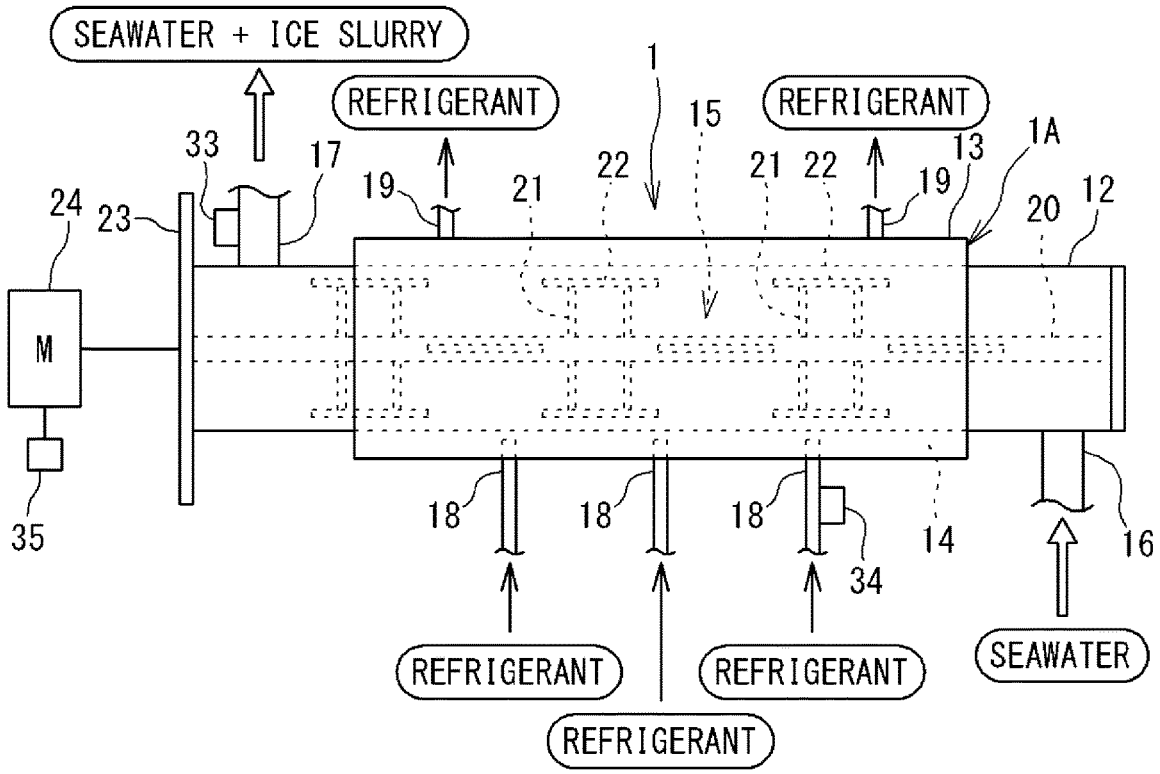
FIG. 2 is an explanatory side view of an ice making machine.
Figure 3:
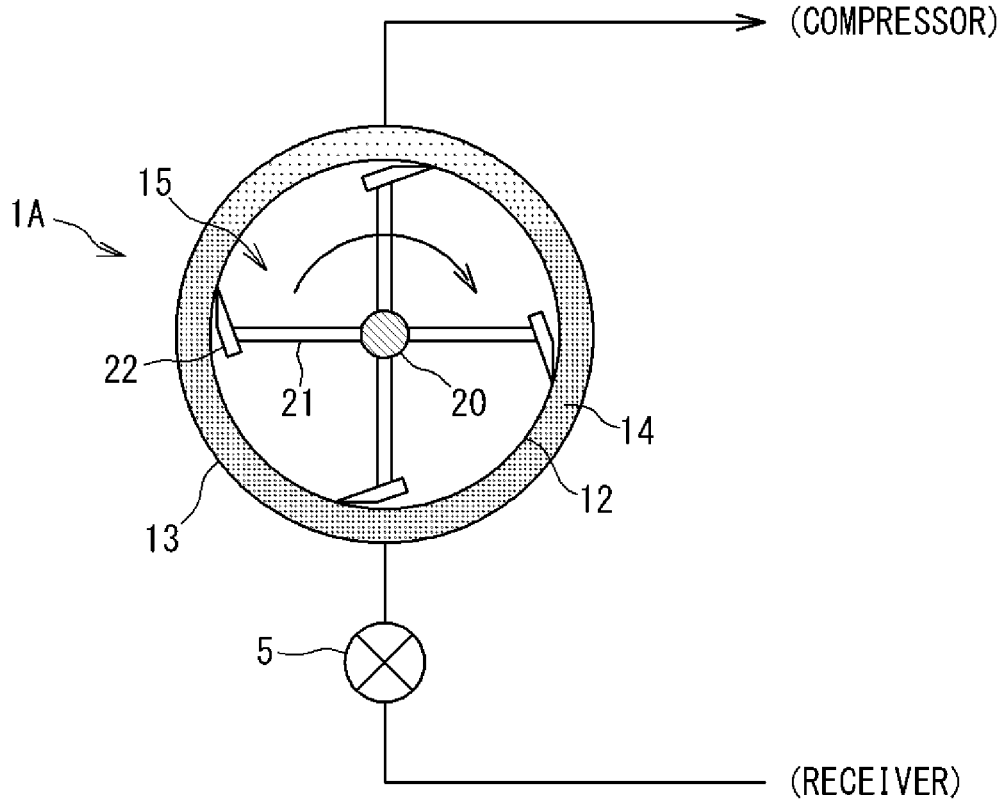
FIG. 3 is an explanatory view schematically showing a cross section of the ice making machine.

FIG. 2 is an explanatory side view of the ice making machine. FIG. 3 is an explanatory view schematically showing a cross section of the ice making machine.

The ice making machine 1 is configured by a double-pipe ice making machine. The ice making machine 1 includes an evaporator 1A as a utilization-side heat exchanger, and a blade mechanism 15. The evaporator 1A includes an inner pipe 12 and an outer pipe 13 each formed in a cylindrical shape. The evaporator 1A is installed horizontally, and thus the axes of the inner pipe 12 and the outer pipe 13 extend horizontally. The evaporator 1A according to one or more embodiments is configured by a flooded evaporator.

The inner pipe 12 is an element through which seawater as a medium to be cooled passes. The inner pipe 12 configures a cooling chamber that cools seawater. The inner pipe 12 is formed of a metal material. Both ends of the inner pipe 12 in the axial direction are closed.

An inlet port 16 for seawater is provided at one end of the inner pipe 12 in the axial direction (right side in FIG. 2). Seawater is supplied into the inner pipe 12 through the inlet port 16. A discharge port 17 for seawater is provided at the other end of the inner pipe 12 in the axial direction (left side in FIG. 2). The seawater in the inner pipe 12 is discharged through the discharge port 17.

The blade mechanism 15 is installed in the inner pipe 12. The blade mechanism 15 scrapes up the sherbet-like ice generated on the inner peripheral surface of the inner pipe 12 and disperses the ice inside the inner pipe 12.

The blade mechanism 15 includes a shaft 20, support bars 21, blades 22, and a drive unit 24. The other end of the shaft 20 in the axial direction extends outward from a flange 23 provided at the other end of the inner pipe 12 in the axial direction and is connected to a motor as the drive unit 24. The support bars 21 are erected at predetermined intervals on the peripheral surface of the shaft 20, and the blades 22 are attached to the tips of the support bars 21. Each of the blades 22 includes, for example, a resin or metal strip member. A side edge of the blade 22 on the front side in the rotation direction has a sharp tapered shape.

The outer pipe 13 is provided coaxially with the inner pipe 12 on the radially outer side of the inner pipe 12. The outer pipe 13 is formed of a metal material. One or a plurality of (in the embodiments shown in FIG. 2, three) refrigerant inlets 18 is provided at a lower part of the outer pipe 13. One or a plurality of (in the embodiments shown in FIG. 2, two) refrigerant outlets 19 is provided at an upper part of the outer pipe 13. Refrigerant that exchanges heat with seawater flows into an annular space 14 between the inner peripheral surface of the outer pipe 13 and the outer peripheral surface of the inner pipe 12. The refrigerant supplied through the refrigerant inlet 18 passes through the annular space 14 and is discharged through the refrigerant outlet 19.

As shown in FIG. 1, the ice making system A includes the control device 50. The control device 50 includes a CPU and a memory. The memory includes, for example, a RAM and a ROM.

The control device 50 realizes various controls regarding an operation of the ice making system A by the CPU executing a computer program stored in the memory. Specifically, the control device 50 controls the opening degrees of the utilization-side expansion valve 5 and the heat source-side expansion valve 27. The control device 50 also controls the operating frequencies of the compressor 2 and the fan 10. The control device 50 further controls driving and stopping of the drive unit 24 of the blade mechanism 15 and the pump 9. The control device 50 may be provided separately on each of the ice making machine 1 and the heat source-side heat exchanger 3. In this case, for example, the control device on the heat source-side heat exchanger 3 can control operations of the heat source-side expansion valve 27, the fan 10, and the compressor 2, while the control device on the ice making machine 1 can control operations of the utilization-side expansion valve 5, the drive unit 24, and the pump 9.

The ice making system A is provided with a plurality of sensors. As shown in FIG. 1, the discharge port 17 of the inner pipe 12 is provided with a temperature sensor (first temperature sensor) 33 that detects the temperature of seawater (and ice slurry) discharged from the inner pipe 12. The ice making machine 1 is provided with a temperature sensor (second temperature sensor) 34 that detects a refrigerant temperature in the evaporator 1A. The drive unit 24 of the blade mechanism 15 of the ice making machine 1 is provided with a current sensor 35 that detects a current value. Detection signals of these sensors are input to the control device 50 and used for various types of control. The temperature sensor 34 in one or more embodiments is mounted at, for example, a main body of the evaporator 1A or the refrigerant pipe, that is, a position where it is possible to measure the temperature of the refrigerant that has exchanged heat in a de-icing operation described later.

<Operation of Ice Making System>

(Ice Making Operation)

Figure 4:
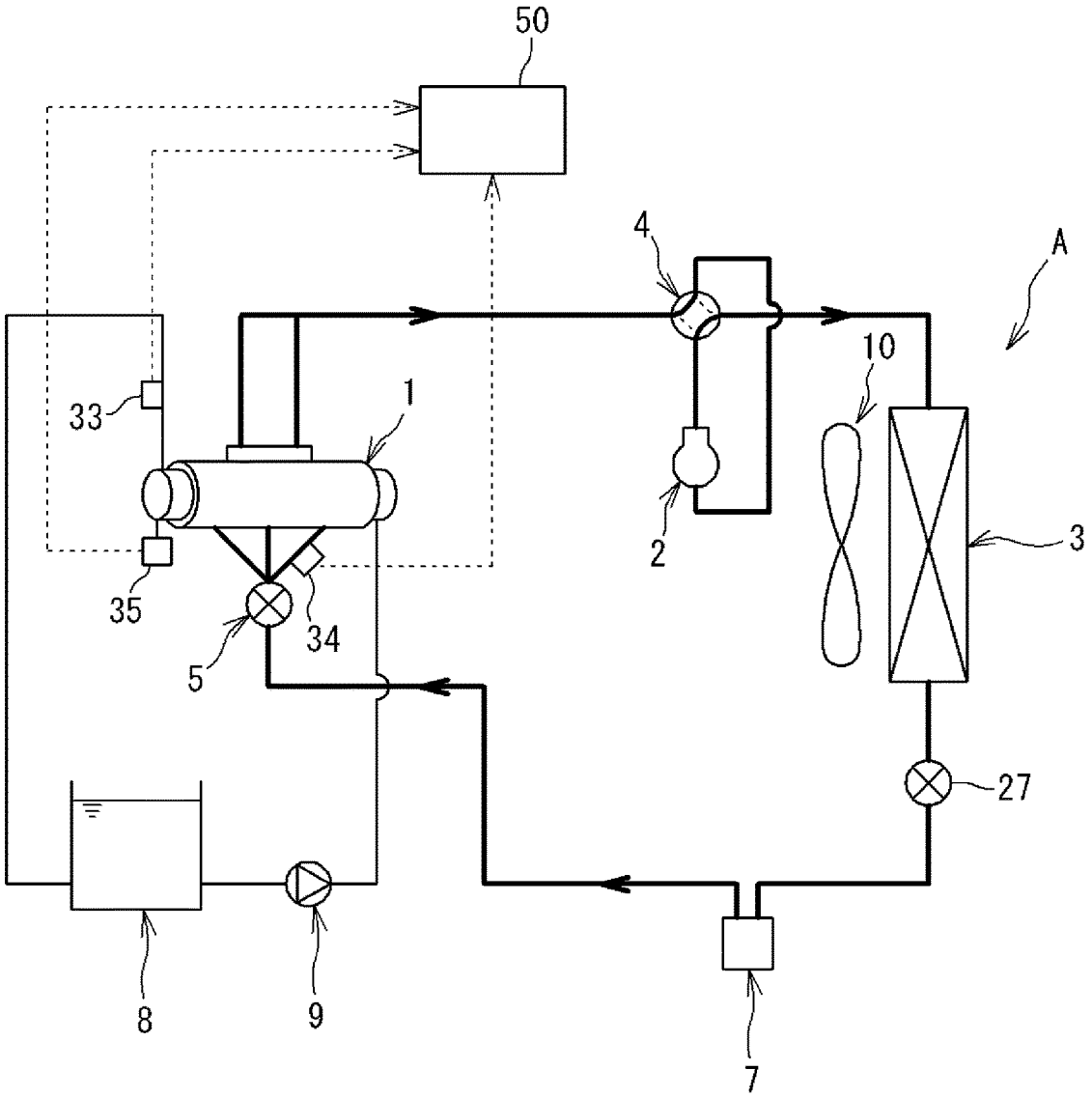
FIG. 4 is a schematic configuration diagram of the ice making system showing a flow of refrigerant during an ice making operation.

FIG. 4 is a schematic configuration diagram of the ice making system showing a flow of refrigerant during an ice making operation.

To perform a normal ice making operation, the four-way switching valve 4 is maintained in a state shown by the solid lines in FIG. 4. High-temperature, high-pressure gas refrigerant discharged from the compressor 2 flows through the four-way switching valve 4 into the heat source-side heat exchanger 3 functioning as a condenser, exchanges heat with air through the operation of the fan 10, and is condensed and liquefied. The liquefied refrigerant flows through the fully opened heat source-side expansion valve 27 and then through the receiver 7, into the utilization-side expansion valve 5.

The refrigerant is decompressed to have a predetermined low pressure by the utilization-side expansion valve 5, becomes gas-liquid two-phase refrigerant, and is supplied through the refrigerant inlet 18 (see FIG. 2) of the ice making machine 1 into the annular space 14 between the inner pipe 12 and the outer pipe 13 that constitute the ice making machine 1. The refrigerant supplied into the annular space 14 exchanges heat with seawater that has flowed into the inner pipe 12 through the pump 9, and evaporates. The refrigerant that has evaporated in the ice making machine 1 is sucked into the compressor 2.

The pump 9 sucks seawater from the seawater tank 8 and pumps the seawater into the inner pipe 12 of the ice making machine 1. The ice slurry generated in the inner pipe 12 is returned to the seawater tank 8 together with the seawater by a pump pressure. The ice slurry returned to the seawater tank 8 rises by buoyancy inside the seawater tank 8 and is accumulated on an upper part of the seawater tank 8.

(De-Icing Operation)

As a result of the ice making operation described above, a phenomenon (ice lock) may occur in which ice gathers and adheres in the inner pipe 12, and the blade 22 of the blade mechanism 15 is caught by the ice, thus increasing a rotational load. This makes it difficult to continue to operate the ice making machine 1. In this case, a de-icing operation (cleaning operation) is performed to melt the ice inside the inner pipe 12.

Hereinafter, the procedure of the de-icing operation will be described with reference to the flowchart shown in FIG. 6.

Figure 6:
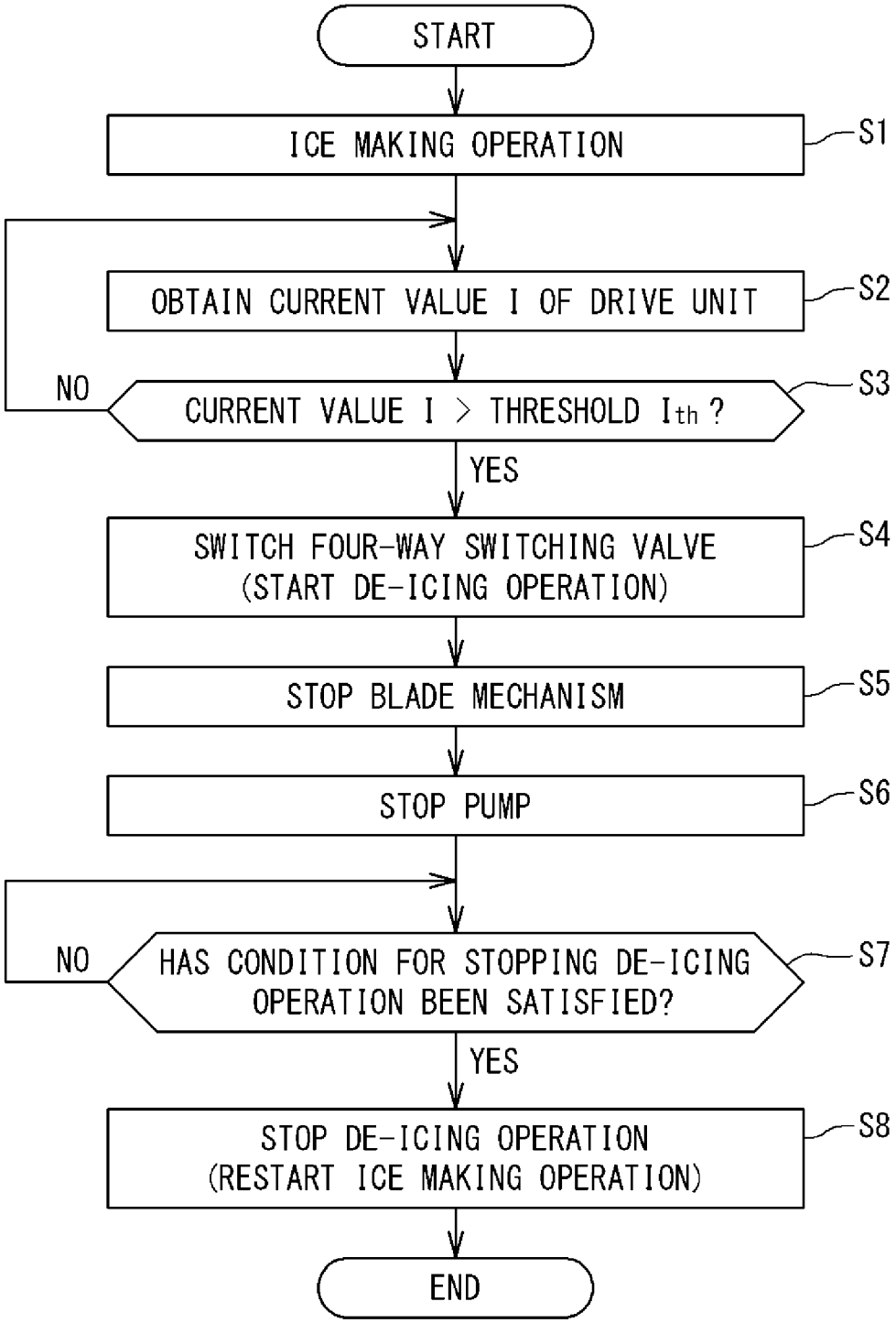
FIG. 6 is a flowchart showing a procedure of shifting from the ice making operation to the de-icing operation.

In FIG. 6, while the ice making system A is performing the ice making operation (step S1), the control device 50 constantly obtains a current value I of the drive unit 24 of the blade mechanism 15 with the current sensor 35 (step S2).

If ice gathers and adheres to the inner peripheral surface of the inner pipe 12, the blade 22 is caught by the ice and the rotation resistance increases, i.e., ice lock occurs. Then, the current value I of the drive unit 24 increases due to the ice lock. Therefore, the control device 50 compares the current value I with a predetermined threshold Ith (step S3) and, when the current value I exceeds the threshold Ith, starts the de-icing operation (step S4).

Specifically, the control device 50 switches the four-way switching valve 4 and reverses the flow of refrigerant during the ice making operation, thereby starting the de-icing operation.

Figure 5:
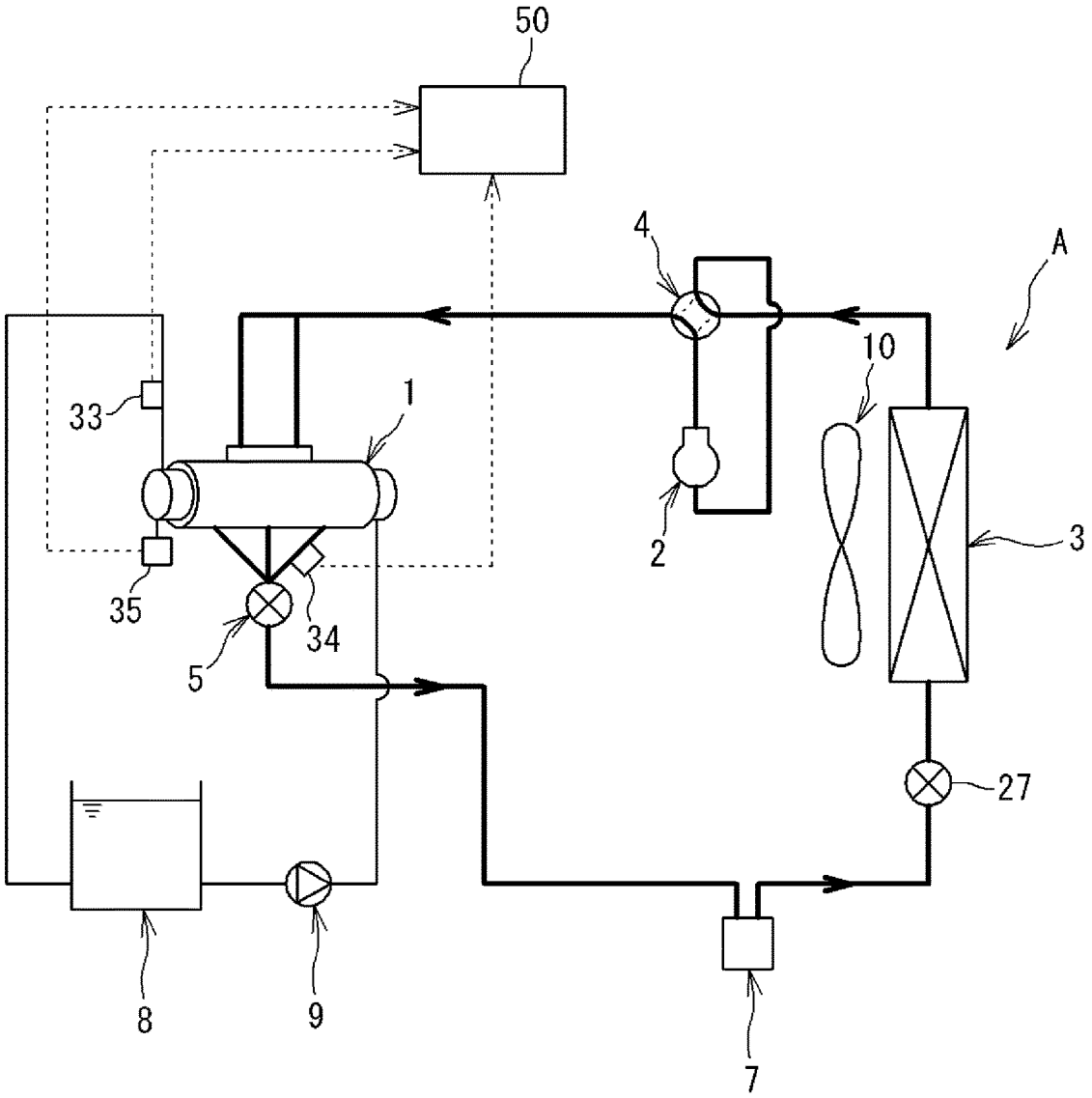
FIG. 5 is a schematic configuration diagram of the ice making system showing a flow of refrigerant during a de-icing operation.

FIG. 5 is a schematic configuration diagram of the ice making system showing a flow of refrigerant during the de-icing operation.

The control device 50 switches the four-way switching valve 4 to a state shown by the solid lines in FIG. 5. The high-temperature gas refrigerant discharged from the compressor 2 flows into the annular space 14 between the inner pipe 12 and the outer pipe 13 of the evaporator 1A via the four-way switching valve 4, exchanges heat with seawater containing ice in the inner pipe 12, and is condensed and liquefied. At this time, the ice in the inner pipe 12 is heated by the refrigerant and melted. The liquid refrigerant discharged from the evaporator 1A passes through the fully opened utilization-side expansion valve 5, and flows into the heat source-side expansion valve 27 via the receiver 7. After being decompressed by the heat source-side expansion valve 27, the liquid refrigerant evaporates in the heat source-side heat exchanger 3 and is sucked into the compressor 2.

Subsequently, the control device 50 stops the blade mechanism 15 (step S5). This can reduce the load on the blade mechanism 15 and suppress, for example, damage to the blade mechanism 15.

The control device 50 also stops the pump 9, and stops the circulation of seawater in the ice making machine 1 (step S6). This can suppress the rise in temperature inside the seawater tank 8, and suppress the melting of the ice accumulated in the seawater tank 8.

The control device 50 determines whether a predetermined condition for stopping the de-icing operation is satisfied and, if the condition is satisfied, stops the de-icing operation and restarts the ice making operation (steps S7, S8). That is, the control device 50 switches the four-way switching valve 4 to the state shown by the solid lines in FIG. 4, and operates the blade mechanism 15 and the pump 9.

(Conditions for Stopping De-Icing Operation)

The de-icing operation can be stopped based on, for example, the following conditions.

(Condition 1) The temperature sensor 34 detects the refrigerant temperature of the evaporator 1A (condenser during the de-icing operation) of the ice making machine 1, that is, the operating temperature of a de-icing mechanism. When the detected temperature exceeds a predetermined threshold, the de-icing operation is stopped. The predetermined threshold can be set to a temperature at which ice adhering to a part inside the inner pipe 12 can be sufficiently melted to such an extent that the ice lock is eliminated, for example, set to 10° C.

(Condition 2) The temperature sensor 33 detects the temperature of seawater at the discharge port 17 of the inner pipe 12. When the detected temperature exceeds a predetermined temperature (for example, 0° C.), the de-icing operation is stopped. This makes it possible to melt the ice adhering to a part inside the inner pipe 12 to such an extent that the ice lock can be eliminated.

The de-icing operation may be stopped when one of Conditions 1 and 2 described above is satisfied. Alternatively, the de-icing operation may be stopped when both of Conditions 1 and 2 are satisfied. Alternatively, only one of the conditions may be adopted.

If ice lock occurs again after the de-icing operation is stopped, the ice lock can be eliminated with the above-described de-icing operation performed again.

Figure 7:
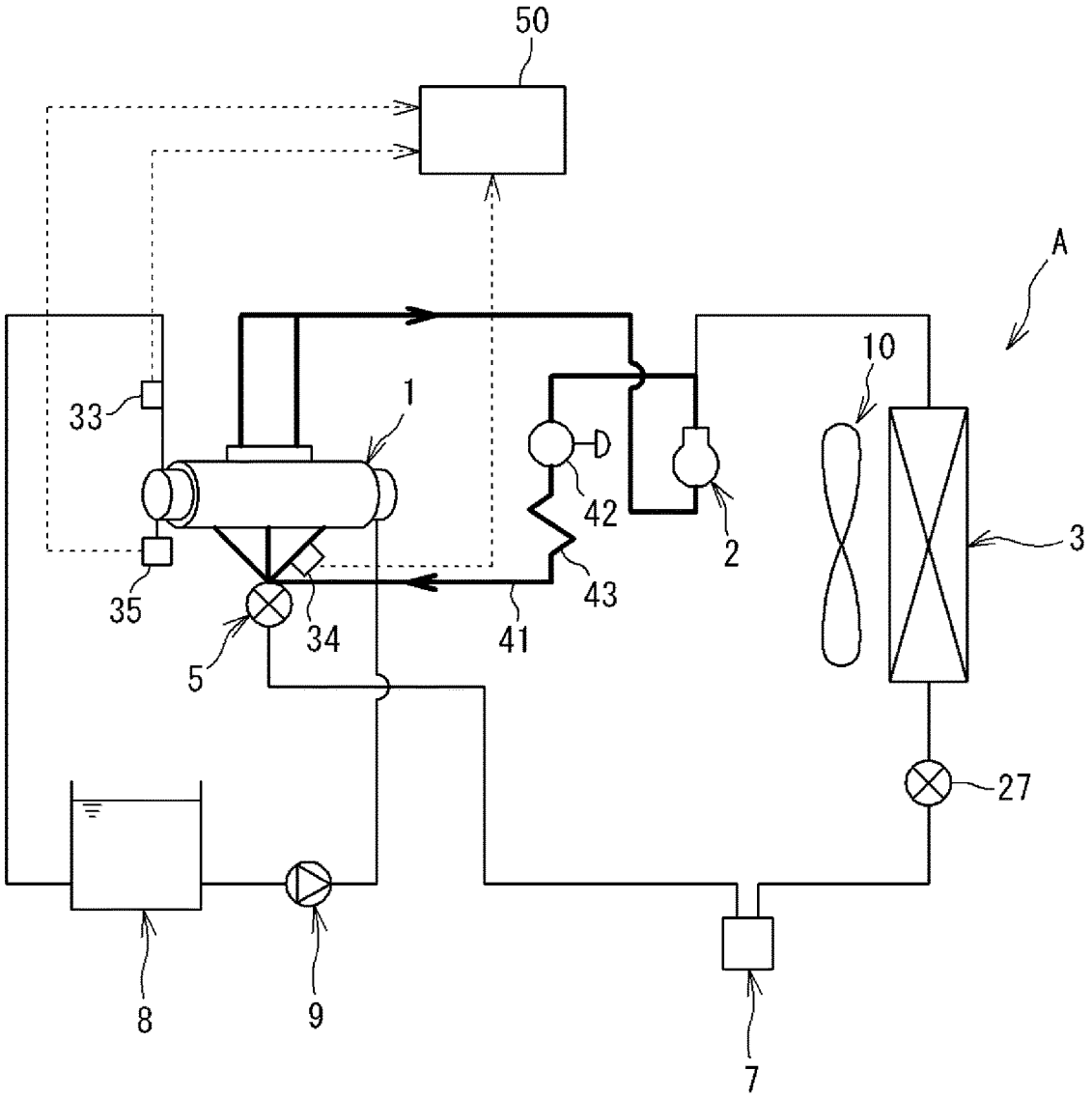
FIG. 7 is a schematic configuration diagram of an ice making system according to one or more embodiments.

FIG. 7 is a schematic configuration diagram of an ice making system according to one or more embodiments.

As in the embodiments described above, a refrigerant circuit of the ice making system A according to one or more embodiments is formed by connecting, with a refrigerant pipe, a compressor 2, a heat source-side heat exchanger 3, a heat source-side expansion valve 27, a receiver 7, a utilization-side expansion valve 5, and an ice making machine 1 in that order.

As described above, the de-icing mechanism in the embodiments described above includes the refrigerant circuit and the four-way switching valve 4 provided in the refrigerant circuit. The four-way switching valve 4 reverses the flow of the refrigerant during the ice making operation, whereby the de-icing operation is performed.

A de-icing mechanism of one or more embodiments does not include a four-way switching valve like the one in the embodiments described above, but includes a bypass refrigerant pipe 41, an on-off valve 42, and an expansion mechanism 43. One end of the bypass refrigerant pipe 41 is connected to a refrigerant pipe between the compressor 2 and the heat source-side heat exchanger 3. The other end of the bypass refrigerant pipe 41 is connected to a refrigerant pipe between the utilization-side expansion valve 5 and the ice making machine 1.

The on-off valve 42 is provided in the bypass refrigerant pipe 41, and is opened or closed to allow or block the flow of refrigerant in the bypass refrigerant pipe 41. The on-off valve 42 is opened and closed under the control of a control device 50. The on-off valve 42 is closed when the ice making operation is performed. The on-off valve 42 can be configured by an electromagnetic valve.

The expansion mechanism 43 decompresses the refrigerant flowing through the bypass refrigerant pipe 41 and lowers the temperature of the refrigerant. The expansion mechanism 43 is configured by a capillary tube. Alternatively, the expansion mechanism 43 may be configured by an expansion valve.

In the ice making system A of one or more embodiments, the control device 50 closes the utilization-side expansion valve 5 and the heat source-side expansion valve 27 and opens the on-off valve 42 in order to perform the de-icing operation. As a result, the high-temperature, high-pressure gas refrigerant discharged from the compressor 2 does not flow to the heat source-side heat exchanger 3 but flows through the bypass refrigerant pipe 41 into the utilization-side heat exchanger 1A of the ice making machine 1. The gas refrigerant is decompressed by passing through the expansion mechanism 43 of the bypass refrigerant pipe 41, and becomes medium-temperature, low-pressure gas refrigerant.

In the utilization-side heat exchanger 1A, the gas refrigerant flows into the annular space 14 between the inner pipe 12 and the outer pipe 13, exchanges heat with seawater containing ice in the inner pipe 12 to have a lower temperature, and becomes low-temperature, low-pressure gas refrigerant. At this time, the ice in the inner pipe 12 is heated by the refrigerant and melted. Thereafter, the gas refrigerant is discharged from the utilization-side heat exchanger 1A and sucked into the compressor 2.

The ice making system A according to one or more embodiments does not require the four-way switching valve 4, thus simplifying the configuration of the refrigerant pipe. Since the utilization-side expansion valve 5 and the heat source-side expansion valve 27 are closed during the de-icing operation, it is not necessary to adjust the opening degree of each of the expansion valves 5 and 27, and the control device 50 can control the expansion valves 5 and 27 in a simplified manner.

[Operation and Effect of Embodiments]

As described above, the ice making system A according to the above embodiments includes: the tank 8 that stores the medium to be cooled; the ice making machine 1 that cools the medium to be cooled and makes ice; the pump 9 that circulates the medium to be cooled between the tank 8 and the ice making machine 1; the de-icing mechanism that performs the de-icing operation of heating and melting the medium to be cooled in the ice making machine 1; and the control device 50 that controls the operations of the ice making machine 1, the pump 9, and the de-icing mechanism. The ice making machine 1 includes: the inner pipe 12 as a cooling chamber for cooling the medium to be cooled; the blade mechanism 15 that rotates in the inner pipe 12 to disperse the ice; and the current sensor 35 as a detector that detects a locked state of the blade mechanism 15. The control device 50 stops the blade mechanism 15 and operates the de-icing mechanism when, during the de-icing operation, the current sensor 35 detects the locked state of the blade mechanism 15. This makes it possible to detect that the ice lock has occurred in the ice making machine 1 and to perform the de-icing operation.

The control device 50 stops the pump 9 during the de-icing operation. This makes it possible to suppress the melting of the ice in the tank 8, which would be caused by a temperature rise in the tank 8.

The ice making system A further includes the refrigerant circuit that is formed by connecting, with the refrigerant pipe, the compressor 2, the heat source-side heat exchanger 3, the heat source-side expansion valve 27 and the utilization-side expansion valve 5 as expansion mechanisms, and the utilization-side heat exchanger 1A in that order. The utilization-side heat exchanger 1A constitutes a part of the ice making machine 1, and exchanges heat with the medium to be cooled in the inner pipe 12 to evaporate the refrigerant during the ice making operation. The de-icing mechanism of one or more embodiments includes the refrigerant circuit and the four-way switching valve 4. The four-way switching valve 4 is connected to the discharge side of the compressor 2 in the refrigerant circuit, and switches the ice making operation to the de-icing operation by switching the flow path of the refrigerant, discharged from the compressor 2, from the path leading to the heat source-side heat exchanger 3 to the path leading to the evaporator 1A. In this manner, the de-icing operation can be performed using the refrigerant circuit in which the ice making machine 1 makes ice.

The ice making system A includes the temperature sensor 34 that detects the operating temperature of the de-icing mechanism. The control device 50 stops the de-icing operation when the temperature detected by the temperature sensor 34 exceeds a predetermined temperature. This makes it possible to appropriately set the timing for stopping the de-icing operation based on the operating temperature of the de-icing mechanism.

The ice making system A includes the temperature sensor 33 that detects the temperature of the medium to be cooled discharged from the inner pipe 12. The control device 50 stops the de-icing operation when the temperature detected by the temperature sensor 33 exceeds a predetermined temperature. This makes it possible to appropriately set the timing for stopping the de-icing operation based on the temperature of the medium to be cooled discharged from the inner pipe 12, and to melt the ice in the inner pipe 12 to such an extent that the ice lock does not occur again when the de-icing operation is switched back to the ice making operation.

[Other Modifications]

The present invention is not limited to the embodiments described above, but various modifications can be made within the scope of the claims For example, in the procedure of the de-icing operation shown in FIG. 6, the de-icing operation that originally starts in step S4 may alternatively start after step S6, or may start between step S5 and step S6.

In the above embodiments, the double-pipe ice making machine is used, but the present invention is not limited to this type of ice making machine. The de-icing mechanism may alternatively be an electric heater or a hot-water (or normal-temperature water) heater, for example, that heats the inner pipe (cooling chamber) 12 of the ice making machine 1 from the outside. In this case, a sensor that measures the temperature of the heater can be adopted as the temperature sensor 34.

In the above embodiments, the temperature sensor 34 detects the refrigerant temperature in the evaporator 1A that functions as a condenser during the de-icing operation. Alternatively, for example, the pressure sensor may detect the pressure (condensation pressure) at the refrigerant outlet or inlet of the evaporator 1A, and the saturation temperature obtained based on the pressure detected by the pressure sensor may be used as the refrigerant temperature of the evaporator 1A.

The receiver may be omitted in the refrigerant circuit. In this case, only one expansion valve as an expansion mechanism may be provided in the liquid-side refrigerant pipe between the heat source-side heat exchanger and the utilization-side heat exchanger.

The medium to be cooled is not limited to seawater, but may be another solution such as ethylene glycol.

There is provided one ice making machine in the above embodiments, but a plurality of ice making machines may be connected in series. There is provided one compressor in the above embodiments, but a plurality of compressors may be connected in parallel.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1: ICE MAKING MACHINE
1A: EVAPORATOR (UTILIZATION-SIDE HEAT EXCHANGER)
2: COMPRESSOR
3: HEAT SOURCE-SIDE HEAT EXCHANGER
4: FOUR-WAY SWITCHING VALVE
5: UTILIZATION-SIDE EXPANSION VALVE (EXPANSION MECHANISM)
8: SEAWATER TANK
9: PUMP
12: INNER PIPE (COOLING CHAMBER)
15: BLADE MECHANISM
17: DISCHARGE PORT
27: HEAT SOURCE-SIDE EXPANSION VALVE (EXPANSION MECHANISM)
33: TEMPERATURE SENSOR (FIRST TEMPERATURE SENSOR)
34: TEMPERATURE SENSOR (SECOND TEMPERATURE SENSOR)
50: CONTROL DEVICE
A: ICE MAKING SYSTEM

The invention claimed is:

1. An ice making system comprising:
a tank that stores a medium to be cooled;
an ice making machine that cools the medium and makes ice;
a pump that circulates the medium between the tank and the ice making machine;
a hot gas loop that performs a de-icing operation of heating and melting the medium in the ice making machine; and
a control device comprising a central processing unit and a memory, wherein the control device controls operations of the ice making machine, the pump, and the hot gas loop, wherein
the ice making machine comprises:
a cooling chamber in which the medium is cooled;
a blade mechanism that rotates in the cooling chamber and disperses the ice;
a detector that detects a locked state of the blade mechanism; and
a first temperature sensor that is disposed at a discharge port of the cooling chamber and detects a temperature of the medium discharged from the cooling chamber,
the control device stops the blade mechanism and operates the hot gas loop when the detector detects the locked state of the blade mechanism, and
the control device stops the de-icing operation when the temperature detected by the first temperature sensor exceeds a predetermined temperature.

2. The ice making system according to claim 1, wherein the control device stops the pump during the de-icing operation.

3. The ice making system according to claim 1, further comprising:

a refrigerant circuit that comprises a refrigerant pipe, a compressor, a heat source-side heat exchanger, an expansion mechanism, and a utilization-side heat exchanger, connected in that order, wherein the utilization-side heat exchanger constitutes a part of the ice making machine, exchanges heat with the medium in the cooling chamber, and evaporates refrigerant during an ice making operation, and the hot gas loop comprises:

the refrigerant circuit; and a four-way switching valve connected to a discharge side of the compressor in the refrigerant circuit, wherein the four-way switching valve switches from the ice making operation to the de-icing operation by switching a flow path of the refrigerant discharged from the compressor from a path leading to the heat source-side heat exchanger to a path leading to the utilization-side heat exchanger.

4. The ice making system according to claim 1, further comprising:

a refrigerant circuit that comprises a refrigerant pipe, a compressor, a heat source-side heat exchanger, a first expansion mechanism, and a utilization-side heat exchanger, connected in that order, wherein the utilization-side heat exchanger constitutes a part of the ice making machine, exchanges heat with the medium in the cooling chamber, and evaporates refrigerant during an ice making operation, and the hot gas loop comprises:

the refrigerant circuit;

a bypass refrigerant pipe that comprises:

one end connected to a refrigerant pipe between the compressor and the heat source-side heat exchanger; and another end connected to a refrigerant pipe between the first expansion mechanism and the ice making machine;

an on-off valve that allows or blocks the flow of refrigerant in the bypass refrigerant pipe; and a second expansion mechanism that decompresses the refrigerant flowing through the bypass refrigerant pipe and lowers a temperature of the refrigerant, and the control device switches from the ice making operation to the de-icing operation by closing the first expansion mechanism and opening the on-off valve.

5. The ice making system according to claim 1, further comprising:

a second temperature sensor that detects an operating temperature of the hot gas loop, wherein the control device stops the de-icing operation when the operating temperature detected by the second temperature sensor exceeds a predetermined temperature.

6. The ice making system according to claim 2, further comprising:

a refrigerant circuit that comprises a refrigerant pipe, a compressor, a heat source-side heat exchanger, an expansion mechanism, and a utilization-side heat exchanger, connected in that order, wherein the utilization-side heat exchanger constitutes a part of the ice making machine, exchanges heat with the medium in the cooling chamber, and evaporates refrigerant during an ice making operation, and the hot gas loop comprises:

the refrigerant circuit; and a four-way switching valve connected to a discharge side of the compressor in the refrigerant circuit, wherein the four-way switching valve switches from the ice making operation to the de-icing operation by switching a flow path of the refrigerant discharged from the compressor from a path leading to the heat source-side heat exchanger to a path leading to the utilization-side heat exchanger.

7. The ice making system according to claim 2, further comprising:

a refrigerant circuit that comprises a refrigerant pipe, a compressor, a heat source-side heat exchanger, a first expansion mechanism, and a utilization-side heat exchanger, connected in that order, wherein the utilization-side heat exchanger constitutes a part of the ice making machine, exchanges heat with the medium in the cooling chamber, and evaporates refrigerant during an ice making operation, and the hot gas loop comprises:

the refrigerant circuit;

a bypass refrigerant pipe that comprises:

one end connected to a refrigerant pipe between the compressor and the heat source-side heat exchanger, and another end connected to a refrigerant pipe between the first expansion mechanism and the ice making machine;

an on-off valve that allows or blocks the flow of refrigerant in the bypass refrigerant pipe; and a second expansion mechanism that decompresses the refrigerant flowing through the bypass refrigerant pipe and lowers a temperature of the refrigerant, and the control device switches the ice making operation to the de-icing operation by closing the first expansion mechanism and opening the on-off valve.

8. The ice making system according to claim 2, further comprising:

a second temperature sensor that detects an operating temperature of the hot gas loop, wherein the control device stops the de-icing operation when the operating temperature detected by the second temperature sensor exceeds a predetermined temperature.

9. The ice making system according to claim 3, further comprising:

a second temperature sensor that detects an operating temperature of the hot gas loop, wherein the control device stops the de-icing operation when the operating temperature detected by the second temperature sensor exceeds a predetermined temperature.

10. The ice making system according to claim 4, further comprising:

a second temperature sensor that detects an operating temperature of the hot gas loop, wherein the control device stops the de-icing operation when the operating temperature detected by the second temperature sensor exceeds a predetermined temperature.

11. The ice making system according to claim 6, further comprising:

a second temperature sensor that detects an operating temperature of the hot gas loop, wherein the control device stops the de-icing operation when the operating temperature detected by the second temperature sensor exceeds a predetermined temperature.

12. The ice making system according to claim 7, further comprising:

a second temperature sensor that detects an operating temperature of the hot gas loop, wherein the control device stops the de-icing operation when the operating temperature detected by the second temperature sensor exceeds a predetermined temperature.

* * * * *